US008960420B2

(12) United States Patent
Crescenzi

(10) Patent No.: US 8,960,420 B2
(45) Date of Patent: Feb. 24, 2015

(54) LENS POD

(71) Applicant: Switch Vision LLC, Fairfield, NJ (US)

(72) Inventor: Deni Crescenzi, Toronto (CA)

(73) Assignee: Switch Vision LLC, Fairfield, NJ (US)

( * ) Notice: Subject to any disclaimer, the term of this patent is extended or adjusted under 35 U.S.C. 154(b) by 0 days.

(21) Appl. No.: 13/792,480

(22) Filed: Mar. 11, 2013

(65) Prior Publication Data

US 2013/0233730 A1 Sep. 12, 2013

Related U.S. Application Data

(60) Provisional application No. 61/608,940, filed on Mar. 9, 2012.

(51) Int. Cl.
*A45C 11/04* (2006.01)

(52) U.S. Cl.
CPC ..... *A45C 11/04* (2013.01)
USPC ..... 206/5

(58) Field of Classification Search
CPC ..... A45C 11/04
USPC ..... 134/901; D3/265; 248/902; 493/914
See application file for complete search history.

(56) References Cited

U.S. PATENT DOCUMENTS

| | | | | |
|---|---|---|---|---|
| 4,596,329 | A * | 6/1986 | Eldridge, Jr. | 206/370 |
| 5,801,806 | A | 9/1998 | DiChiara | |
| 6,270,216 | B1 | 8/2001 | DiChiara | |
| 6,726,004 | B2 * | 4/2004 | Watson | 206/6 |
| 6,890,073 | B2 | 5/2005 | DiChiara et al. | |
| 7,137,700 | B2 | 11/2006 | DiChiara et al. | |
| 7,380,655 | B1 * | 6/2008 | Thune et al. | 206/214 |
| 7,543,930 | B2 | 6/2009 | DiChiara | |
| 7,665,625 | B1 * | 2/2010 | Rothstein et al. | 220/326 |
| 7,850,301 | B2 | 12/2010 | DiChiara | |
| 8,092,007 | B2 | 1/2012 | DiChiara | |
| 2003/0173234 | A1 * | 9/2003 | Lin | 206/5 |
| 2004/0183994 | A1 | 9/2004 | DiChiara et al. | |
| 2005/0280771 | A1 | 12/2005 | DiChiara et al. | |
| 2006/0242745 | A1 | 11/2006 | DiChiara | |
| 2008/0304005 | A1 | 12/2008 | DiChiara | |
| 2009/0051866 | A1 | 2/2009 | DiChiara | |
| 2009/0257019 | A1 | 10/2009 | DiChiara | |
| 2010/0064422 | A1 | 3/2010 | DiChiara | |
| 2011/0007263 | A1 | 1/2011 | DiChiara | |
| 2012/0005811 | A1 * | 1/2012 | McCrory et al. | 2/439 |
| 2012/0019770 | A1 | 1/2012 | DiChiara | |

* cited by examiner

*Primary Examiner* — Anthony Stashick
*Assistant Examiner* — Mollie Llewellyn
(74) *Attorney, Agent, or Firm* — Lerner, David, Littenberg, Krumholz & Mentlik, LLP

(57) ABSTRACT

An apparatus for enclosing and protecting individualized lenses has a base and a lid rotatably attached to each other. Each of the base and the lid have pockets for receiving each of the lenses. Each of the pockets have a perimeter that forms a boundary of the respective base and lid. The base and the lid each have a bumper adapted for supporting one of the lenses and a magnetic mating element attached at the respective perimeter of the base or lid. Each of the magnetic mating elements is detachably attached to and provides a magnetic hinge for a coupling element of one of the lenses. The apparatus has a closed position in which a lid closure magnet is detachably attached to a base closure magnet and an open position in which the closure magnets are not in contact with each other.

17 Claims, 4 Drawing Sheets

SECTION 4-4

SECTION 6-6

LENS POD

CROSS-REFERENCE TO RELATED APPLICATION

The present application claims the benefit of the filing date of U.S. Provisional Patent Application No. 61/608,940 filed Mar. 9, 2012, the disclosure of which is hereby incorporated herein by reference.

BACKGROUND OF THE TECHNOLOGY

The present technology relates to enclosures for protecting articles, and more particularly, to cases for lenses for eyewear.

Over at least the past decade, complete pairs of eyewear have been placed into ornamental felt-lined cases to protect them from scratching and other damage when they are not in use. Such casings often have a base and a lid rotated about a hinge and adapted to completely enclose the eyeglasses. Recent advancements in lenses, however, have allowed for the separation of the lenses of the eyeglasses from their corresponding frames. In many cases, such lenses are individualized left and right lenses that do not have a rim to protect them once they are separated from the frames. Such lenses are meant to be quickly interchangeable in response to outdoor lighting conditions and thus need to be readily available away from user's residences. Thus, there is a need for a portable protective casing for individualized sets of lenses that are detachable from the rims.

BRIEF SUMMARY OF THE TECHNOLOGY

In accordance with one aspect of the technology, an apparatus for protecting at least one lens having a thickness and a perimeter about the lens may include a base that may have a pocket sized to contain one lens. The apparatus may further include a lid that may be rotatably attached along at least a first portion of the lid to at least a first portion of the base. The lid may include a pocket sized to contain one lens. At least one of the base and the lid may have a bumper adapted for supporting a lens and at least one magnetic mating element attached at the perimeter on an end of the one or both of the base or the lid having such a bumper. Any such mating element may be detachably attached to and provide a magnetic hinge for at least one coupling element of the one lens. The apparatus may be in a closed position in which a second portion of the lid is in contact with a second portion of the base. The apparatus may be in an open position in which the second portion of the lid is not in contact with the second portion of the base.

In some arrangements, the apparatus may include a lens separator that may extend from a side of one of the base and the lid. In some configurations, the pocket of the base may be configured to contain a first lens and the pocket of the lid may be configured to contain a second lens. In such configurations, each of the first and second lenses may have opposing concave and convex surfaces. The lens separator may be curvate such that, when the first and second lenses are contained in the respective the lens separator is curvate such that, when the first and second lenses are contained in the respective base and lid, and the apparatus is in the closed position, the separator is between the lenses and conforms to at least one of the convex surface of the first lens and the concave surface of the second lens. In some configurations, the lens separator has a resilience such that the lens separator is biased to be separated from one of the base and the lid when the apparatus is in the open position.

In some arrangements, the lid may be rotatably attached to the base about a hinge pin. Optionally, the apparatus may include a biasing member to bias the lid in at least one of the open and closed positions. In some configurations, the lid may be rotatably attached to the base about a hinge. The hinge may have a pin in engagement with the base and the lid. The biasing member may be a spring coiled about the pin.

In some arrangements, the coupling element of the lens may be a first magnet, and the mating element of the apparatus may be a corresponding second magnet for attracting the first magnet in a seated position. In some configurations, the second magnet may have first and second portions and each of the pockets of the base and the lid may have an interior. The second magnet may be aligned such that the first portion of the second magnet faces towards the interior of the pocket attached to the second magnet and the second portion of the second magnet faces away from the interior of the pocket attached to the second magnet. The first portion of the second magnet may attract at least a part of the first magnet and the second portion of the second magnet may repel at least the part of the first magnet to guide the first magnet to the seated position. In some configurations, the pocket attached to the second magnet may be attached through a mount. The first portion of the second magnet may have a face for contacting a mating face of the first magnet. The mount may be configured to tilt the face of the second magnet at an acute angle with a bottom of the pocket attached to the second magnet to provide a magnetic hinging force such that the lens, upon insertion, rotates towards the pocket attached to the second magnet.

In some alternative arrangements, the bumper may include a post member inserted within a flexible portion. In some arrangements, the bumper may be separated from the mating element such that, when a lens is supported by the bumper, the lens rests on the bumper and the mating element. Optionally, the second portions of the base and the lid are magnets that when near one another bias the apparatus in the closed position. Optionally, the respective second portions of the lid and the base may be clasps. The apparatus may be in the closed position when the second portion of the lid overlaps at least a portion of the second portion of the base such that the respective second portions of the lid and the base are compressively engaged to form a clasp.

In accordance with another aspect of the technology, a lens protection system may include an arrangement of the apparatus in which the base and the lid each have respective first and second bumpers and first and second mating elements and in which each of the first and second mating elements may be respective first and second magnets. The lens protection system may further include first and second lenses each having a body and a magnetic coupling element. The first lens may be insertable into the pocket of the base such that the body of the first lens rests on the bumper of the base and the magnetic coupling element may be detachably attached to the first magnet of the base. The second lens may be insertable into the pocket of the lid such that the body of the second lens rests on the bumper of the lid and the magnetic coupling element is detachably attached to the second magnet of the lid.

DETAILED DESCRIPTION

Figure 1A:
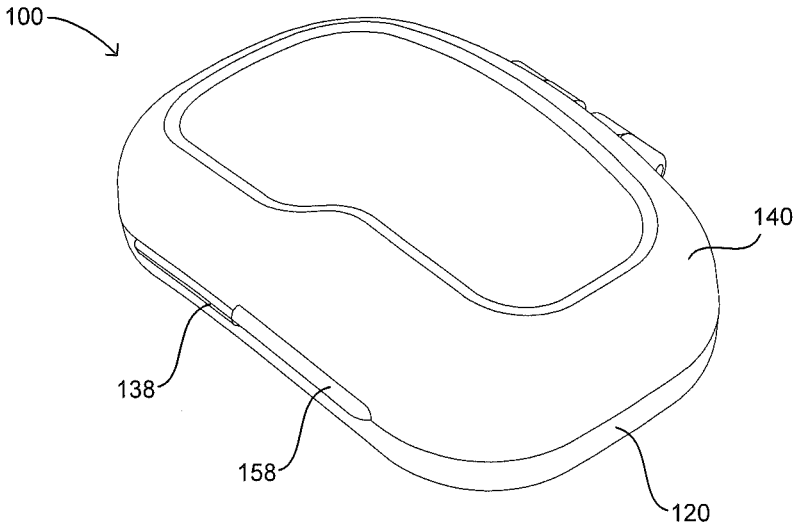
FIGS. 1A and 1B are perspective views of an apparatus, shown in the closed and open positions, respectively, for protecting lenses in accordance with an embodiment of the present technology.
Figure 1B:
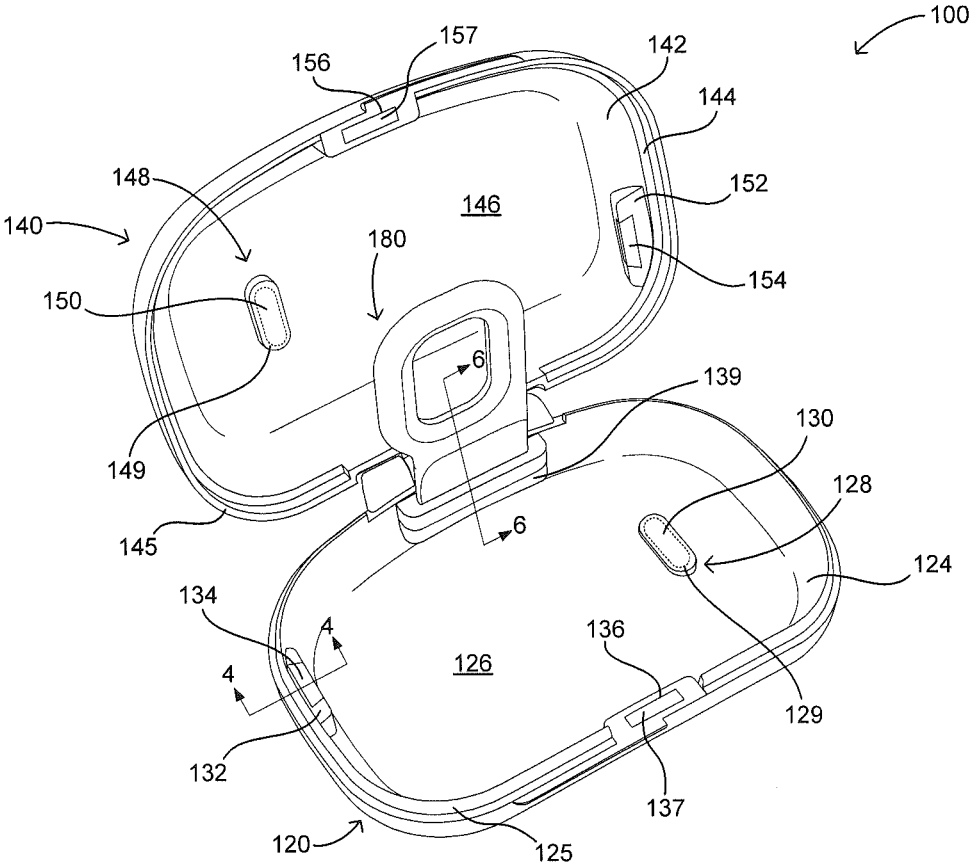
Figure 2:
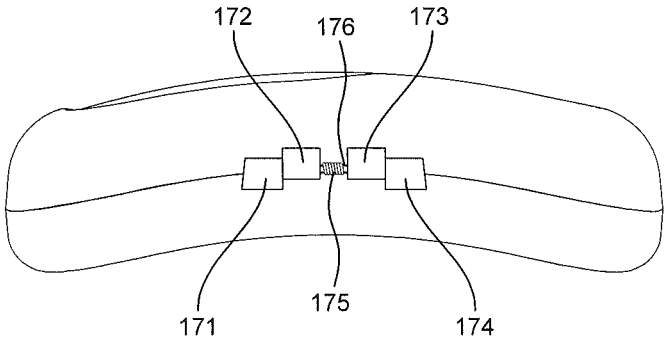
FIG. 2 is a side view of the apparatus of FIG. 1.
Figure 3:
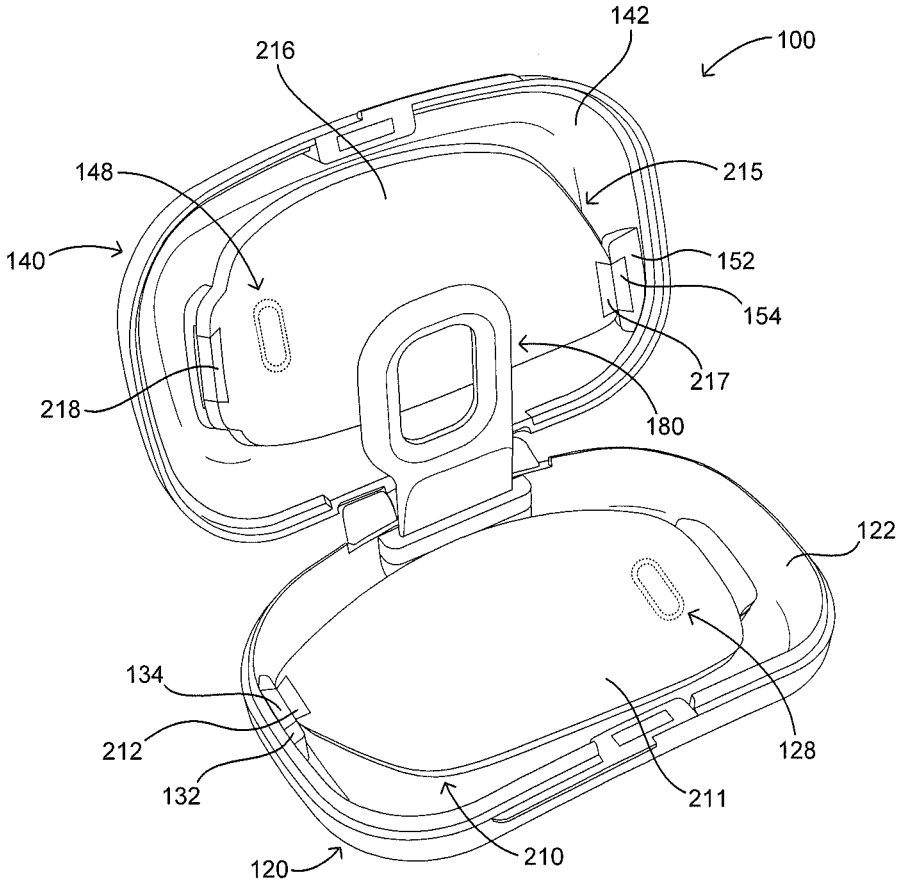
FIG. 3 is a perspective view of the apparatus of FIG. 1, shown with a set of lenses supported therein in accordance with an embodiment of the present technology.

Referring now to FIGS. 1-3, in accordance with one example embodiment of the technology, a pod 100 may include a base 120 and a lid 140 that, when in a closed position as shown in FIG. 1A, form an enclosure that may be used to protect articles such as individualized eyeglass lenses. Although the pod 100 may be used for other types of articles, in the example pod 100 shown throughout the FIGS. AA-6, the pod 100 is intended for use with individualized eyeglass lenses and the description that follows shall be directed to such lenses. In this manner, as best shown in FIGS. 1A and 2, the base 120 and the lid 140 may be curvate to conform to the shape of lenses for insertion therein. In a typical embodiment, the pod may be formed of a hard material to provide a protective shell for one or two individualized lenses.

As best shown in FIG. 1B in which the pod 100 is in an open position, the base 120 may include a base pocket 122 for receiving a lens. The base pocket 122 may have a base bottom 126 for providing support to a lens placed into the base pocket 122 and a base perimeter 124 extending from an edge of and circumscribing the base bottom 126. When a lens is placed into the base pocket 122, the base perimeter 124 serves as a boundary surrounding the lens.

As further shown in FIG. 1B, a base bumper 128 may extend from the base bottom 126. In the embodiment shown, the base bumper 128 may include a base post member 130 inserted into or formed with the base bottom 126 and a base shell 129 that covers the base post member 130. The base post member 130 may be attached to the base bottom 126 through various known methods of attachment including, but not limited to, through the use of an interference fit or an adhesive such as epoxy. The base shell 129 may be a soft, flexible material to cushion a lens inserted into the base pocket 122. Rubber, foam, or other soft materials may be used for the base shell 129.

To support a lens inserted into the pod 100, the base bumper 128 may be laterally offset from a center of the base pocket 122, and a base mount 132 may be placed a distance away from the base bumper 128 on an opposite side of the center of the base pocket 122. In this manner, in the example shown in FIG. 3, a right lens 210 may be placed into the base 120 such that it is supported by the base bumper 128 proximate to one end of the lens and the base mount 132 at the opposite end of the lens. In particular, a portion of a right lens body 211 may rest on the base bumper 128 and a coupling element 212 attached at an edge of the body 211 of the right lens 210 may be attached through a base mating element 134 to the base mount 132 when the right lens 210 is inserted into the base 120. Furthermore, as shown in FIG. 3, the right lens body 211 and the base pocket 122 may be curved such that a concave surface of the lens body 211 is supported by the bumper 128 and the mount 132 and substantially conforms to the shape of a convex surface of the base pocket 122. In such a way, the case size may be minimized even though the lens body 211 does not rest upon the convex surface of the base pocket 122. In this regard, the lens may be supported solely by the small area of the base bumper 128 in contact with a small portion of the single lens and one magnetic edge of the lens end.

Figure 4:
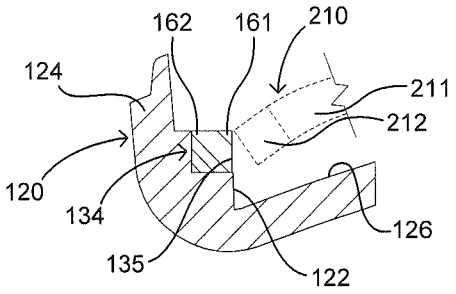
FIG. 4 is a side cross-sectional view of a mount and mating element of the apparatus of FIG. 1.

As shown in FIGS. 1B and 3, the base mount 132, which may include a magnetic coupler, may be located such that it extends from an end (as shown in FIGS. 1B and 3, on a left end when the pod 100 is in the open position with the pockets 122 and 142 visible) the base perimeter 124 towards the center area of the base pocket 122. As shown in these figures and as best shown in the detailed view of FIG. 4, the base mating element 134, such as a magnet or magnetic material, may be inserted into a portion of the base mount 132. As shown by FIGS. 3 and 4, the base mating element 134 may be placed at an inner position within and may be oriented with respect to the base mount 132 such that, when the right lens 210 is contained within the base 120, a side of the coupling element 212 contacts a face 135 of the base mating element 134.

As further shown in FIG. 4, the face 135 of the base mating element 134 forms part of a first portion 161 of the base mating element 134 that is closer to the center (and extends or protrudes into the center area) of the base pocket 122 than a second portion 162 of the base mating element 134. The base mating element 134 may be a magnet in which the first and second portions 161, 162 have opposite magnetic poles respectively. Furthermore, the right lens coupling element 212 may be a magnetic material or magnet as well. In the case of the magnet, the right lens coupling element 212 may be oriented with its magnetic poles so that the edge of the lens attracts the magnet of the base mating element 134 when the lens is seated within the pocket of the pod. In this manner, during insertion of the right lens 210 into the base 120, the first portion of the coupling element 212 may be attracted to the first portion 161 of the base mating element 134 and the second portion of the coupling element 212 may repel from the second portion 162 of the base mating element 134 such that the coupling element 212, and hence the right lens 210 is guided to the face 135 of the base mating element 134 with repelling and attracting magnetic forces until the coupling element becomes attached when in the proper seated position. Such guiding occurs because the repelling forces between the second portions of the coupling element and the base mating element prevent contact between these portions, creating a floating or hovering effect until the first portions of the coupling element and the base mating element become near enough that the attractive forces between them overcome the repelling forces between the second portions.

As further illustrated in FIG. 4, the base mating element 134 may be inserted into the base mount 132 such that the face 135 is set at an acute angle with the base bottom 126. As the strongest magnetic force of the base mating element 134 is directed perpendicularly to the face 135, during insertion of the right lens 210, the attraction forces between the first portions of the coupling element 212 and the base mating element 134 cause the coupling element 212, and hence the attached right lens body 211, to rotate towards an alignment with the strongest magnetic force of the base mating 134 and hence to be perpendicular to the face 135. However, the placement of the base bumper 128 acts as a limit on the rotational travel of the right lens body 211 and thus limits the rotational travel of the coupling element 212. In this way, the magnets and their orientation provide a magnetic hinging effect at one end of the lens to rotatably draw the opposing side of the lens into position within the pod pocket to hold or ply the lens against the bumper with the magnetic hinging force.

Referring again to FIG. 1B, the lid 140 may have features similar to those just described for the base 120 allowing for the pod 100 to receive and contain a second individualized lens therein. However, in the example shown in this figure, a lid bumper 148 may be placed in a configuration relative to a lid mount 152 and lid mating element 154 inserted within the lid mount 152 that is opposite to the relative locations of the base bumper 128 and the base mount 132 and base mating element 134 inserted within the base mount 132. Furthermore, when attached to the base 120, the lid 140 may be in an inverted configuration relative to the base 120 in which the lid 140 has a lid top 146 that opposes the base bottom 126 and a lid perimeter 144 that engages the base perimeter 124 of the base 120. In this manner, as shown in FIG. 3, a left lens 215 having a left lens body 216 and a left lens coupling element 217 configured as a mirror image of the right lens 210 may be inserted or formed into and contained within the lid 140 such that the left lens body 216 will be held against the lid bumper 148 when the coupling element 217 magnetically couples to the lid mating element 154 on the lid mount 152 with the magnetic hinging effect. Furthermore, as shown, the left lens body 216 and the lid pocket 142 may be curved such that a convex surface of the lens body 216 is supported by the bumper 148 and the mount 152 and substantially conforms to the shape of a concave surface of the lid pocket 142.

In some embodiments, as is shown in the example of FIG. 3, the coupling element 217 may be a magnet. The angled orientation of a face of the lid mating element 154 for engaging the left lens coupling element 217 may be similar to that described previously herein for the engagement between the right lens coupling element 212 and the base mating element 134. In the example of FIG. 3, the attractive force between the left lens coupling element 217 and a portion of the lid mating element 154 with their particular orientation may provide the magnetic hinging force to maintain the left lens body 216 against the lid bumper 148 when the left lens 215 is seated in the lid 140. The base mating element 134 may have a similarly magnetic hinging force with respect to the right lens coupling element 212 to maintain the right lens body 211 against the base bumper 128.

Still referring to FIG. 3, when the right and left lenses 210, 215 are contained in their seated positions with their respective coupling elements 212, 217 engaged with the respective mating elements 134, 154 within the pod 100, the reversed configuration of these elements enables a concave surface of the left lens body 216 opposite the convex surface of the left lens body 216 described previously herein to substantially conform to a convex surface of the right lens body 211 opposite the concave surface of the right lens body 211 described previously herein when the pod 100 is in the closed position. Such a configuration minimizes the space required within the pod 100 to fit both lenses compared with alternative configurations in which the surfaces of the lens bodies do not substantially conform to one another.

The right and left lenses 210, 215 may be spaced apart when the pod 100 is in the closed position when they are in the seated position against the respective base bumper 128 and lid bumper 148, as previously described herein. However, to prevent any contact between the lenses 21, 215 during movement or impact with other objects or the ground should the pod 100 be dropped, a lens separator 180 may be included, such as by attachment to or extension from within the pod 100, to provide an additional protection to the lenses. As shown in the example of FIG. 3, the lens separator 180 may be insertable within and extend from a separator interface 139, as discussed further herein, protruding from a rear position of the base pocket 122 towards the lid 140.

Figure 5:
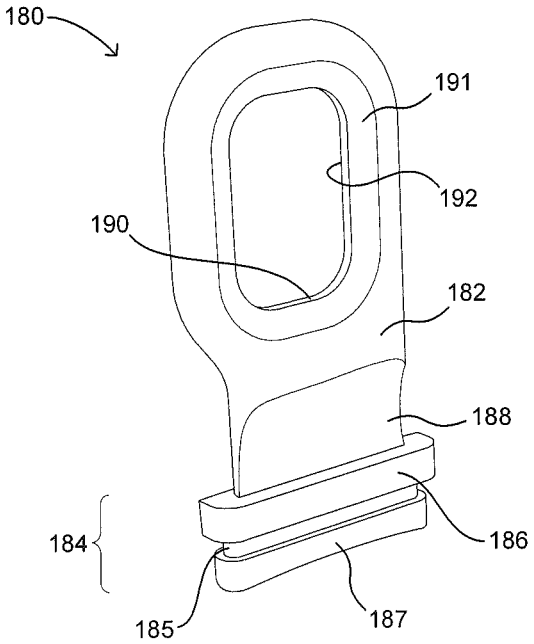
FIG. 5 is a perspective view of a lens separator of FIG. 1, shown disassembled from the apparatus.

As shown in FIG. 5, the lens separator 180 may have a separator body 182 extending from an insertion section 184. The separator 180 may be composed of a rubber or foam material, similar to that of the base shell 129 or a lid shell 149 that is placed over a lid post member 150 and that may be identical to the base shell 129 but used on the lid 140. Other soft materials may also be used. In this manner, the body 182 of the separator 180 may have a thickness such that when the pod 100 is in the closed position, the separator 180 may be placed between the lenses 210, 215 to provide a barrier and as well as cushioning between the lenses. Thus, when the pod is closed, the separator may rest between and cushion both lenses. However, the separator may be formed with resilience such that when the pod is opened, the separator will stand away from both lenses providing easy access for the removal of each lens.

As further shown in FIG. 5, the separator 180 may additionally have an inner perimeter 190 that forms a hole therethrough. First and second chamfers 191, 192 may be formed at an interface between the separator body 182 and the inner perimeter 190. In this manner, when the pod 100 is in the closed position, the first chamfer 191 may rest against the right lens 210 and the second chamfer 192 may rest against the left lens 215. Furthermore, the hole within the inner perimeter 190 may permit portions of the right and left lens bodies 211, 216 to fit within the inner perimeter 190 to reduce the mechanical stress that may otherwise be induced by compression of the lens separator 180 against the lenses 210, 215.

Figure 6:
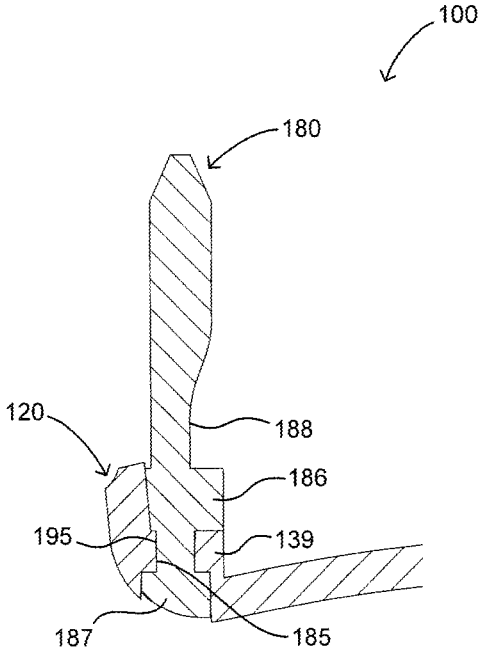
FIG. 6 is side cross-sectional view of a portion of an interface between the lens separator of FIG. 5 and a base of the apparatus of FIG. 1.

Referring to FIGS. 5 and 6, the insertion section 184 of the lens separator 180 may have a groove 185 bounded by an upper portion 186 and a lower portion 187 across a length of the lens separator 180. The corresponding separator interface 139 that engages the insertion section 184 of the lens separator 180 may include a perimeter 195 through which passes a hole having a length, a width, or a length and a width that is smaller than the corresponding length, width, or length and width of the upper and lower portions 186, 187 of the insertion section 184. In this manner, the groove 185 may be inserted and seated into the hole formed by the perimeter 195. The dimensions of the insertion section 184 of the lens separator 180 and the separator interface 139 may be set to allow for removal of the lens separator 180 from the base 120.

As shown in FIGS. 3, 5, and 6, the body 182 of the lens separator 180 may have a recess 188 located between the inner perimeter 190 and the insertion section 184 of the lens separator 180 that faces towards the front of the pod 100. The recess may be a thinner section than the remainder of the body 182. In this manner, when the lens separator 180 is inserted into the base 120, the lens separator 180 may bend inwardly at the recess 188 such that the lens separator 180 is spaced a distance from both the base 120 and the lid 140 but closer to the base 120 when the recess faces toward the front of the pod 100 and closer to the lid 140 when the recess faces toward the rear of pod 100.

As shown in FIGS. 1A and 2, the pod 100 may form an enclosure and, accordingly, may contain the right and left individualized lenses 210, 215 in the base 120 and the lid 140, respectively, when in the closed position. As shown in FIG. 2, the pod 100 may have a pin 176 through a first base hinge member 171 and first lid hinge member 172 on one side and a second lid hinge member 173 and second base hinge member 174 on an opposite side of a biasing member 175 through which the pin extends. In this manner, the base 120 and the lid 140 may rotate about the pin 176 relative to one another to place the pod 100 in the open and closed positions. In the embodiment shown, the biasing member 1754 is a spring coiled around the pin 176. When the pod 100 is in the closed position, the spring may be in compression such that it biases the lid 140 to be in the open position.

Referring now to FIG. 1B, when in this closed position, the base perimeter 124 of the base 120 may have an inner lip 125 that extends into an outer lip 145 of the lid perimeter 144 of the lid 140 to provide sealing around the portions of the pod 100 where the inner lip 125 engages the outer lip 145. Along the base perimeter 124 on a side opposite the pin 176, the base 120 may be further provided with a base recess 136 having a base closure magnet 137 seated therein. Similarly, along the lid perimeter 144 on a side opposite the pin 176, the lid 140 may be further provided with a lid recess 156 having a lid closure magnet 157 seated therein. When rotating the base 120 and the lid 140 towards the closed position, the base and lid closure magnets 137, 157 may be attracted to one another to bias the base 120 and the lid 140 in the closed position. The attraction force between the base 120 and the lid 140 may be strong enough to overcome the opposing force of the biasing member 175 such that the pod 100 remains in the closed position once the base and the lid closure magnets 137, 157 come into contact. A base flange 138 may extend from a portion of the base 120 and a lid flange 158 may extend from a portion of the lid 140 on the front side of the pod 100 opposite the pin 176 on an exterior of the pod 100. In this manner, when the pod 100 is in the closed position, the flanges 138, 158 may provide leverage for opening the pod 100.

In alternative configurations to the example just described, the base and lid bumpers and the corresponding base mating element along with the base mount and lid mating element with the lid mount may be placed in reverse configurations to those shown in the figures. Thus, the mating elements would extend from the edges of the base and the lid bottoms on the ends of the base and the lid, respectively, opposite the ends in which the mating elements are located in the example shown in the figures. In this manner, right and left lenses having the configurations previously described herein may be placed in the lid and the base, respectively. In other arrangements, the bumpers and mating elements may be placed in other regions of the base and the lid as needed to interface with coupling elements and bodies of lenses to be contained therein.

In some embodiments, either the mating elements or the interfacing coupling elements may only be metals, such as iron, that are attracted to the other of the mating element or the interfacing coupling element that is a magnet. In further embodiments, the lens separator may be placed in the lid rather than the base. In still further embodiments, the separator may be integrated with the base or the lid from which it extends. In other alternative configurations, the biasing member may be a spring that biases the pod closed, adding to the attractive force of the closure magnets.

Further arrangements of the pod may have lids that do not rotate relative to the base. In such arrangements, the lid and the base may have lips or flanges or a combination thereof around their respective perimeters that interface with one another along the perimeter of the base and the lid to enable the lid to snap onto the base. In this manner, the lid and the base may be completely separated from one another when in the open position.

It is to be understood that the disclosure set forth herein includes all possible combinations of the particular features set forth herein. For example, where a particular feature is disclosed in the context of a particular aspect, arrangement, configuration, or embodiment, or a particular claim, that feature can also be used, to the extent possible, in combination with and/or in the context of other particular aspects, arrangements, configurations, and embodiments of the technology, and in the technology generally.

Furthermore, although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. An apparatus for protecting at least one lens of a set of lenses, the at least one lens having a thickness and a perimeter thereabout, comprising:

a base having a pocket sized to contain one lens;

a lid rotatably attached along at least a first portion thereof to at least a first portion of the base, the lid having a pocket sized to contain one lens;

wherein at least one of the base and the lid has (i) a bumper adapted for supporting one lens of the set of lenses thereon and (ii) at least one magnetic mating element attached thereto on a first end of the at least one of the base and the lid, the at least one magnetic mating element for detachably attaching to and providing a magnetic hinge for at least one coupling element of the one lens, wherein the apparatus is in a closed position when a second portion of the lid, which is opposite the first portion of the lid, is in contact with a second portion of the base and an open position when the second portion of the lid is not in contact with the second portion of the base, and wherein the first end and a second end opposite the first end are on different sides of the one of the base and the lid than the second portion of the one of the base and the lid such that upon attachment of the one lens to the at least one magnetic mating element, the one lens extends from the first end to the second end.

2. The apparatus of claim 1, further comprising a lens separator extending from a side of one of the base and the lid.

3. The apparatus of claim 2, wherein each of a first and a second lens of the set of lenses have opposing concave and convex surfaces, and wherein the lens separator is curvate such that, when the first and second lenses are contained in the respective base and lid, and the apparatus is in the closed position, the lens separator is between the lenses and conforms to at least one of the convex surface of the first lens and the concave surface of the second lens.

4. The apparatus of claim 3, wherein the lens separator has a resilience such that the lens separator is biased to be separated from one of the base and the lid when the apparatus is in the open position.

5. The apparatus of claim 1, wherein the lid is rotatably attached to the base about a hinge pin.

6. The apparatus of claim 1, further comprising a biasing member to bias the lid in at least one of the open and closed positions.

7. The apparatus of claim 6, the lid being rotatably attached to the base about a hinge having a pin in engagement with the base and the lid, wherein the biasing member is a spring coiled about the pin.

8. The apparatus of claim 1, the at least one coupling element of the at least one lens being a first magnet, wherein the at least one magnetic mating element of the apparatus is a corresponding second magnet for attracting the first magnet in a seated position.

9. The apparatus of claim 8, the second magnet having first and second portions and the pockets of the base and the lid having an interior therein, wherein the second magnet is aligned such that the first portion faces towards the interior of the pocket attached to the second magnet and the second portion faces away from the interior of the pocket attached to the second magnet, and wherein the first portion of the second magnet is adapted to attract at least a part of the first magnet and the second portion of the second magnet is adapted to repel at least the part of the first magnet to guide the first magnet to the seated position.

10. The apparatus of claim 9, the pocket attached to the second magnet being attached through a mount and the first portion of the second magnet having a face for contacting a mating face of the first magnet, wherein the mount and a bottom of the pocket attached thereto are arranged such that an angle between the face of the second magnet and the bottom of the pocket is acute, the second magnet thereby providing a magnetic hinging force such that the at least one lens, upon insertion, rotates towards the pocket attached to the second magnet.

11. The apparatus of claim 1, wherein the bumper includes a post member inserted within a flexible portion thereof.

12. The apparatus of claim 1, wherein the bumper is separated from the at least one magnetic mating element such that the one lens is adapted to be rested against and supported by only the bumper and the at least one magnetic mating element.

13. The apparatus of claim 1, wherein the second portions of the base and the lid include magnets that when near one another bias the apparatus in the closed position.

14. The apparatus of claim 1, wherein when the apparatus is in the closed position, at least a portion of the second portion of the lid overlaps at least a portion of the second portion of the base.

15. A lens protection system for removable lenses comprising the apparatus of claim 3, wherein the base and the lid each have respective first and second bumpers and first and second magnetic mating elements, each of the first and second magnetic mating elements being respective first and second magnets, the lens protection system further comprising:

first and second lenses each having a body and a magnetic coupling element, wherein the first lens is insertable into the pocket of the base such that the body of the first lens rests on the bumper of the base and the magnetic coupling element is detachably attached to the first magnet of the base, and wherein the second lens is insertable into the pocket of the lid such that the body of the second lens rests on the bumper of the lid and the magnetic coupling element is detachably attached to the second magnet of the lid.

16. The apparatus of claim 1, wherein when the apparatus is in the closed position, at least a portion of each of the respective second portions of the lid and the base are compressively engaged to form a clasp.

17. An apparatus for protecting at least one lens of a set of lenses, the at least one lens having a thickness and a perimeter thereabout, comprising:

a base having a pocket sized to contain one lens;

a lid rotatably attached along at least a first portion thereof to at least a first portion of the base, the lid having a pocket sized to contain one lens;

wherein at least one of the base and the lid has (i) a bumper adapted for supporting one lens of the set of lenses thereon and (ii) at least a first magnet attached thereto on an end of the at least one of the base and the lid, the at least one first magnet for detachably attaching to and providing a magnetic hinge for at least one second magnet of the one lens and for attracting the second magnet in a seated position;

wherein the first magnet has first and second portions and the pockets of the base and the lid have an interior therein, the first magnet being aligned such that the first portion faces towards the interior of the pocket attached to the first magnet and the second portion faces away from the interior of the pocket attached to the first magnet, and wherein the first portion of the first magnet is adapted to attract at least a part of the second magnet and the second portion of the first magnet is adapted to repel at least the part of the second magnet to guide the second magnet to the seated position, wherein the pocket attached to the first magnet is attached through a mount and the first portion of the first magnet has a face for contacting a mating face of the second magnet, wherein the mount and a bottom of the pocket attached thereto are arranged such that an angle between the face of the first magnet and the bottom of the pocket is acute, the first magnet thereby providing a magnetic hinging force such that the one lens, upon insertion, rotates towards the pocket attached to the first magnet, and wherein the apparatus is in a closed position when a second portion of the lid is in contact with a second portion of the base and an open position when the second portion of the lid is not in contact with the second portion of the base.

* * * * *